US005740577A

United States Patent [19]

Wade

[11] Patent Number: 5,740,577

[45] Date of Patent: Apr. 21, 1998

[54] TOOL FOR CLEANING CRACKS AND GROOVES IN PAVEMENT

[76] Inventor: Stanley Wade, 10245 4th Ave., Los Angeles, Calif. 90303

[21] Appl. No.: 802,439

[22] Filed: Feb. 18, 1997

[51] Int. Cl.[6] ..... A47L 25/00

[52] U.S. Cl. ..... 15/104.001; 15/236.01

[58] Field of Search ..... 15/104.001, 236.01, 15/236.03, 236.05, 236.07, 236.08, 236.09, 245.1; 37/265; 172/371, 372, 375, 380, 381; D8/45, 7, 11; D32/46, 49

[56] References Cited

U.S. PATENT DOCUMENTS

| | | | |
|---|---|---|---|
| 435,500 | 9/1890 | Hyde | 15/236.07 |
| 671,381 | 4/1901 | Jenkins | 172/371 |
| 902,124 | 10/1908 | Voshell | 172/375 |
| 946,322 | 1/1910 | Blake | 172/371 |
| 1,190,338 | 7/1916 | Stevens | 172/371 |
| 1,206,678 | 11/1916 | Cribbs | 172/375 |
| 1,473,143 | 11/1923 | Dean | 15/236.01 |
| 1,931,349 | 10/1933 | Habig | 172/371 |
| 2,535,253 | 12/1950 | Anderson | 15/236.01 |
| 4,517,700 | 5/1985 | Pinto | 15/236.01 |
| 4,817,229 | 4/1989 | Sedillo | 15/245.1 |
| 5,440,777 | 8/1995 | Olivieri | 15/236.08 |
| 5,546,625 | 8/1996 | Mealey, Sr. | 15/236.05 |
| 5,606,761 | 3/1997 | Lynch | 15/236.05 |

FOREIGN PATENT DOCUMENTS

| | | | |
|---|---|---|---|
| 2330294 | 6/1977 | France | 172/371 |
| 0561595 | 5/1944 | United Kingdom | 15/236.08 |

*Primary Examiner*—Randal Chin
*Attorney, Agent, or Firm*—Benman & Collins

[57] ABSTRACT

A tool for cleaning cracks, grooves, channels and spacings in pavement. The inventive tool comprises an elongate pole having a longitudinal axis and a flat blade having at least one vertex, said blade being disposed at one end of said pole whereby said vertex may engage the ground when said pole is held at a predetermined angle with respect to said surface. In a specific implementation, the tool has a wooden pole and metallic blade and includes first and second vertices disposed at opposing ends of a first edge on the blade extending along an axis transverse to the longitudinal axis of the pole. In alternative embodiments, an edge of the blade between the pole and the vertex is straight or curved in a concave or convex manner or some combination thereof as may be required for particular applications.

2 Claims, 1 Drawing Sheet

TOOL FOR CLEANING CRACKS AND GROOVES IN PAVEMENT

BACKGROUND OF THE INVENTION

1. Field of the Invention

The present invention relates to gardening tools and the like. More specifically, the present invention relates to tools and techniques for cleaning cracks and grooves in sidewalks, driveways, streets and other paved surfaces.

2. Description of the Related Art

Concrete has been used for some time to pave roads and paths to provide streets and sidewalks, respectively. As is well known in the art, concrete (composed primarily of cement, sand and gravel) expands and contracts considerably when exposed to heat and cold respectively. This expansion can lead to cracking if the concrete is not appropriately sectioned. Accordingly, some sections of concrete are conventionally separated by expansion joints, sections of compressible material, which allow for expansion and contraction of the concrete. While this approach is effective for the most part, some cracking of the concrete occurs nonetheless.

In any event, the spacing between sections, whether filled with expansion material or not, and the cracks in the concrete are generally quickly filled with dirt and debris. Soon seeds and spores take root and begin to sprout. In some cases, grass and weeds push up through the crack from below. If such growth is not terminated, it could lead to further displacement of the concrete leading to further cracking and damage to the pavement.

Hence, it has been the practice in the art to remove such growth along with the dirt and debris from the cracks before damage to the pavement occurs. Certain tools have been developed to facilitate the cleaning of such cracks. The primary tool being used currently has a broad wedge shaped tip which is difficult to insert deeply into the crack.

Accordingly, a need remains in the art for further improvements in tools and implements used to clean cracks, channels, grooves and spacings in pavement.

SUMMARY OF THE INVENTION

The need in the art is addressed by the present invention which provides a tool for cleaning cracks, grooves, channels and spacings in pavement. The inventive tool comprises an elongate pole having a longitudinal axis and a flat blade having at least one vertex, said blade being disposed at one end of said pole whereby said vertex may engage the ground when said pole is held at a predetermined angle with respect to said surface.

In a specific implementation, the tool has a wooden pole and metallic blade and includes first and second vertices disposed at opposing ends of a first edge on the blade extending along an axis transverse to the longitudinal axis of the pole.

In alternative embodiments, an edge of the blade between the pole and the vertex is straight or curved in a concave or convex manner or some combination thereof as may be required for particular applications.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
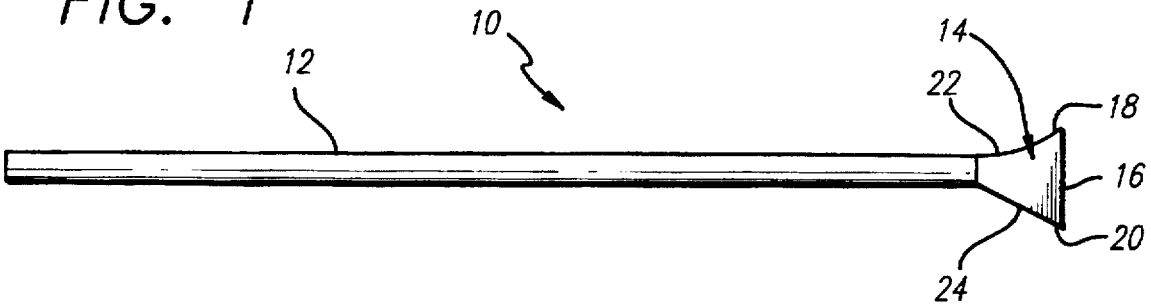
FIG. 1 is a plan view of the tool of the present invention.
Figure 2:
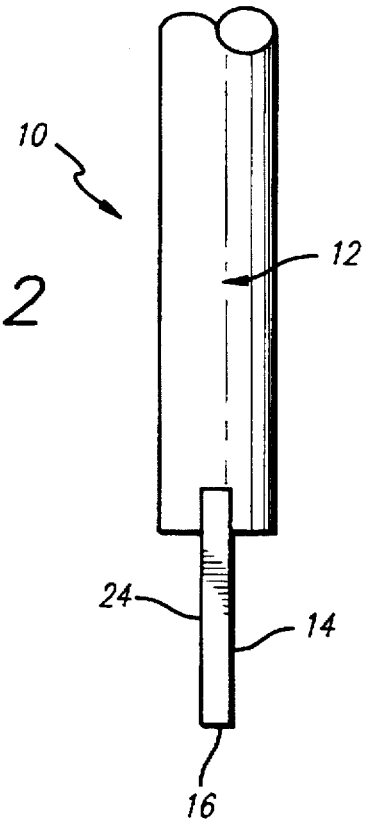
FIG. 2 is a partial side view showing the blade end of the tool of the present invention.

FIG. 1 is a plan view of the tool of the present invention. FIG. 2 is a partial side view showing the blade end of the tool of the present invention. As shown in FIGS. 1 and 2, the tool 10 includes a pole 12. The pole 12 may be constructed of wood, metal, plastic or other suitable material as is known in the art. The pole is elongate and of sufficient length to permit one to touch the blade 14 to the ground without bending or stooping. Hence, in the illustrative embodiment, the pole is three to four feet in length.

The blade 14 is disposed at one end of the pole 12. The blade 14 is a flat planar piece of metal or other suitable material. The blade 14 has a first edge 16 which extends along an axis transverse to the longitudinal axis of the pole 12. A first vertex 18 is provided at one end of the first edge 16 and a second vertex 20 is provided at a second end of the edge 16. Each vertex provides a sharp point which may be inserted into a crack, channel, groove or spacing in pavement to clean growth, dirt, and/or debris from same.

A second edge 22 of the blade 14 extends between the first vertex 18 and the pole 12. As shown in FIG. 1, the second edge is curved in a concave manner. In the alternative embodiment, the edge 22 is curved in a convex manner.

A third edge 24 extends between the second vertex 20 and the pole 12. The third edge is shown as a straight edge. The curvature of the edges, if any, is chosen to suit the requirements of a particular application. A concave curvature provides a more sharp point for deep penetration. A concave curvature provides for more edge area for scooping dirt out of the crack or channel. A straight edge provides a compromise between the concave and convex edges.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention. Accordingly,

What is claimed is:

1. A tool for cleaning cracks, grooves, channels and spacings in pavement including:

an elongate pole having a longitudinal axis and a flat blade disposed at one end of said pole, said blade having a first vertex and a second vertex, said first and second vertices being disposed at first and second ends of a first edge on said blade extending along an axis transverse to the longitudinal axis of said pole, said blade further including a second edge extending between said pole and said first vertex and a third edge extending between said pole and said second vertex, said second edge being concavely curved along its entire length from said pole to said first vertex and said third edge being straight.

2. A tool for cleaning cracks, grooves, channels and spacings in pavement including:

an elongate pole having a longitudinal axis and a flat blade having a first edge extending along an axis transverse to the longitudinal axis of said pole with first and second vertices at opposing ends thereof, said blade including a second edge which is concavely curved along its entire length from said first vertex to said pole and a third edge which is straight and extends from said second vertex, said blade being disposed at one end of said pole whereby one of said vertices may engage the ground when said pole is held at a predetermined angle with respect to said ground.

* * * * *